US011116345B2

(12) United States Patent
Sankaran

(10) Patent No.: US 11,116,345 B2
(45) Date of Patent: Sep. 14, 2021

(54) COLLAPSIBLE WALL MOUNTED SECURITY BOX FOR PACKAGES

(71) Applicant: Sanjeevkumar Killikulangara Sankaran, Diamond Bar, CA (US)

(72) Inventor: Sanjeevkumar Killikulangara Sankaran, Diamond Bar, CA (US)

( * ) Notice: Subject to any disclaimer, the term of this patent is extended or adjusted under 35 U.S.C. 154(b) by 40 days.

(21) Appl. No.: 16/036,840

(22) Filed: Jul. 16, 2018

(65) Prior Publication Data

US 2020/0015616 A1 Jan. 16, 2020

(51) Int. Cl.

| | |
|---|---|
| ***A47G 29/124*** | (2006.01) |
| ***B65D 5/36*** | (2006.01) |
| ***A47G 29/20*** | (2006.01) |

(52) U.S. Cl.

CPC ..... *A47G 29/124* (2013.01); *A47G 29/20* (2013.01); *B65D 5/3635* (2013.01); *A47G 2029/1257* (2017.08)

(58) Field of Classification Search

CPC .. A47G 29/124; A47G 29/1257; A47G 29/14; A47G 29/16; A47G 29/20; A47G 2029/144; A47G 2029/148; B65D 5/3635; B65D 7/20; B65D 7/24; B65D 7/26; B65D 7/28; B65D 21/086; A01K 31/08; A01K 1/033; A01K 1/034

USPC ..... 232/1 E, 19, 38, 45; 220/6, 7, 480; 119/474

See application file for complete search history.

(56) References Cited

U.S. PATENT DOCUMENTS

| | | | | |
|---|---|---|---|---|
| 1,673,769 | A * | 6/1928 | Graham | G07C 13/02 220/6 |
| 1,915,980 | A * | 6/1933 | Craft | A47G 29/12 232/19 |
| 2,229,646 | A * | 1/1941 | Firestone | A47G 29/1223 220/6 |
| 2,456,479 | A * | 12/1948 | Antil | A47G 29/14 220/6 |
| 6,426,699 | B1 | 7/2002 | Porter | |
| 6,722,315 | B2 | 4/2004 | Sinor | |
| 8,733,292 | B2 * | 5/2014 | Nichols | A01K 1/03 119/474 |
| 9,339,006 | B1 * | 5/2016 | Eby | A01K 1/034 |
| 10,076,204 | B1 * | 9/2018 | Sadeghi | A47G 29/141 |
| 10,321,780 | B1 * | 6/2019 | James | B65D 21/0235 |
| 10,537,196 | B1 * | 1/2020 | MacPherson | A47G 29/20 |
| 10,696,453 | B2 * | 6/2020 | Sena | A47G 29/141 |
| 10,709,276 | B2 * | 7/2020 | Guanch | A47G 29/20 |
| 2001/0040422 | A1 * | 11/2001 | Gramlich | A47G 29/141 312/234 |
| 2005/0224567 | A1 * | 10/2005 | Stagnaro | A47G 29/1223 232/35 |
| 2012/0186529 | A1 | 7/2012 | Cantwell et al. | |

(Continued)

*Primary Examiner* — William L Miller

(74) *Attorney, Agent, or Firm* — Ariel S. Bentolila; Bay Area IP Group, LLC

(57) ABSTRACT

A device having a front, top, bottom and side panel components, in which each panel includes a front panel mesh and a surrounding bar portion, wherein said surrounding bar portion is configured to support said front panel mesh, a first locking mechanism, a second locking mechanism, a back support panel component configured to be operable for mounting onto a wall with screws, and a hinge mechanism, wherein said hinge mechanism is configured to be operable for allowing the device to be folded or collapsed when not in use.

19 Claims, 4 Drawing Sheets

(56) References Cited

U.S. PATENT DOCUMENTS

| | | | | |
|---|---|---|---|---|
| 2016/0068306 | A1* | 3/2016 | Heinz | B65D 81/02 220/560.01 |
| 2016/0331171 | A1* | 11/2016 | Jiang | G06Q 10/0833 |
| 2017/0188737 | A1* | 7/2017 | Hippert | A47G 29/20 |
| 2018/0228310 | A1* | 8/2018 | Enobakhare | A47G 29/1207 |
| 2018/0296016 | A1* | 10/2018 | Teoh | A47G 29/20 |

* cited by examiner

Box when collapsed

Top View

Front View

Side Perspective View

Side View

Closed (Folded) Box

Front View

COLLAPSIBLE WALL MOUNTED SECURITY BOX FOR PACKAGES

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a mail delivery receptacle. More particularly, certain embodiments of the invention relate to a self-locking and collapsible box delivery receptacle.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Currently a person who receives mail deliveries at their home/apartment while they are not at home commonly has limitations on box/package sizes they can receive securely. Standard mail slots for dropping off envelopes/smaller packages are typically too slim for large boxes. Official US Post large box delivery drivers may have an option of a large box locker with a key (usually a landlord issued key given to a renter is used), but non-US Post's (for example but not limited to private companies such as UPS's © or FedEx's ©) delivery drivers do not have access to a secure large box receptacle/locker. Non-US Post delivery drivers may also not have access to a slim standard slot. Therefore, Non-US Post delivery drivers usually leave boxes unattended in a public or dangerous area and hide it in hopes it isn't stolen. Furthermore still, US Post box receptacles usually take up a large space due to its mounting. For example, a US Post box receptacle/locker is commonly secured to a large cement block. Installing this type of a box receptacle at a small home or apartment would likely be a complex project to a large group of people. Furthermore still, having an empty large box receptacle when you are not actively receiving large boxes may be unsightly or a large waste of space.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, an aspect of the prior art generally useful to be aware of is that while there may currently be some approaches to storing large boxes in a foldable/collapsing receptacle such as an animal crate made with wires, there may generally be concerns with designing a folding mechanism for a high security application using high security sturdy building parts. Repurposing something like a large foldable animal wire crate with a pad lock into a delivery box receptacle would typically not be tamper resistant enough for possibly expensive products in a public/busy/downtown/dangerous neighborhood. A crate repurposing solution also may not be relatively easy for a delivery driver to operate while holding on to a large box. Furthermore still, whatever container may be repurposed it would not be easily mounted onto a securing base. Furthermore still, parts required to build this would need to be security grade thick materials which may require redesigning a collapsing mechanism in order to accommodate thicker shaped parts, more mounting screws needed to fully secure a receptacle, and making it easier for a delivery driver to quickly drop a box off.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
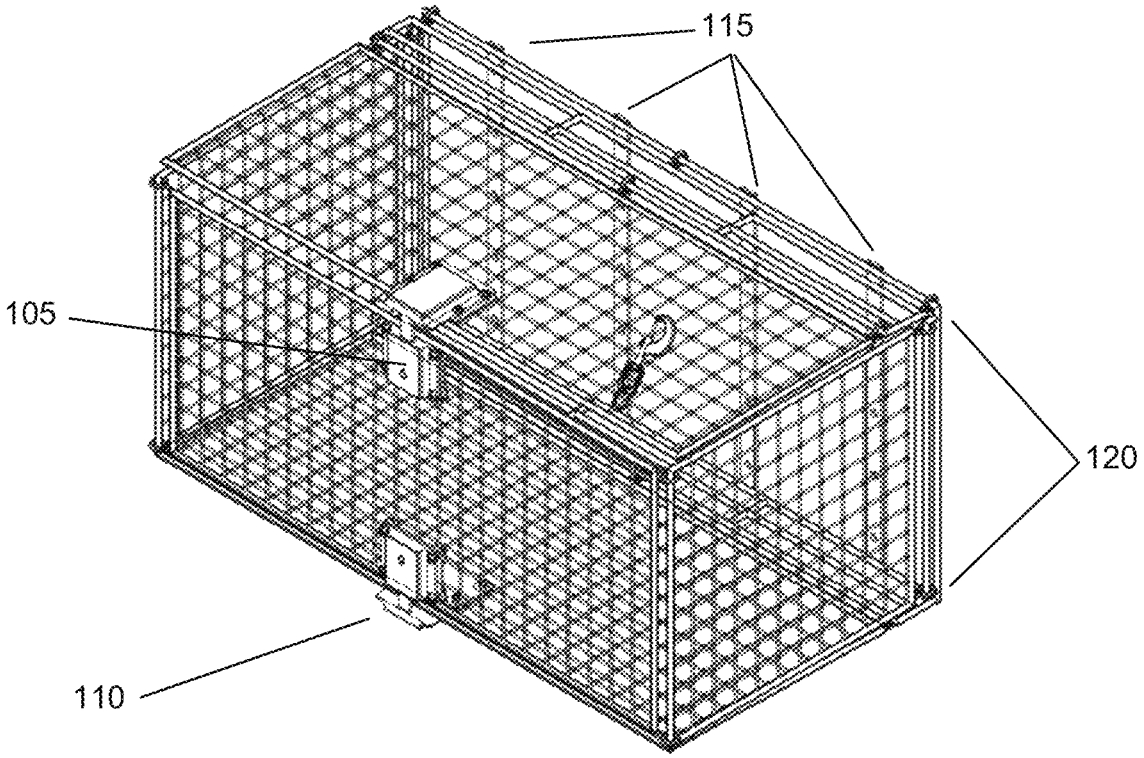
FIG. 1 illustrates an exemplary box receptacle in a closed/locked state, in accordance with an embodiment of the invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hollinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an improved box/package delivery receptacle/compartment/locker device. In an exemplary embodiment a box/package delivery receptacle may be collapsible and may use special hinges to help a folding mechanism and may use a one-time use self-locking mechanism to simplify delivery. The device may be wall mounted and used for receiving packages and the device may be collapsed when not in use. Furthermore, a box receptacle device may be mounted onto an existing wall using a back support panel and may use a mesh security grade building material. The material used may include but not limited to steel mesh and may be coated with all-weather resistant paint which may keep the device free from defect when exposed to prolonged period in an outdoor environment. A box receptacle device may come with a plurality of back support strips with holes for security screws on a back panel which may help with wall mounting, this may allow a user to install a receptacle onto either a larger home wall or small apartment wall relatively easily. The plurality of back support strips may include but not limited to metal strips, plastic strips, steel bars, etc. A box receptacle may come with a plurality of metal strips with holes for security screws which may be used in a wall attachment. A wall for mounting may be on a user's front porch/door or any part of a wall, where limited porch real estate may be maximized using a space saving receptacle. A box receptacle device may be collapsible when not in use, which may save space by folding up into a flat piece against a wall. Alternatively, a receptacle may be multipurpose which may fold into a piece of furniture for a porch and when unfolded it may provide a delivery driver a table and/or easy drop off self-locking receptacle, this may simplify operation for a delivery driver and provide a useful chair to a porch when it's not in use. Furthermore, a receptacle may use a foot pedal to start an unfolding mechanism. A box receptacle may be set up using security/tamper resistant screws, and similar security/tamper resistant building parts. A box receptacle may be made from a steel mesh. Special hinge pieces may be customized to simplify folding/collapsing and unfolding/un-collapsing. Special hinge pieces may allow a receptacle to move 180 degrees on a wall for folding. The special hinges may allow the side and front panels of the device to move horizontally towards the right or left all the way toward the wall making it flush before unfolding the floor panel and top panels. A delivery driver therefore may be able to relatively easily open a box receptacle due to its improved folding and placement guides. A package recipient may then later use their key to open it whenever they get back home. The top panel may lock by itself (without keys) when closed and can be opened only with keys. The locking mechanism on the floor panel may secure the device from bottom. The guide pin on the top panel may align with the holes in the side panel, which helps position the device before the lock is engaged. The device will be made as a single or multiple compartments, each compartment will have its own locking mechanism.

Compared with a prior solution repurposing something like a collapsible animal crate with a padlock to use as a delivery box receptacle, this prior solution may still lack a design for high security applications where a top concern may be mounting to a secure base/wall. Furthermore, a pet cage may be collapsible, but it may still lack an easy installation, and ease of operation. Furthermore still, an improved box receptacle may simplify a delivery for a delivery driver by having a box receptacle that may be easy to open, may swing into place using special hinges and placement guides, then may self-lock so a delivery driver may speedily complete a delivery. Therefore, use of a delivery security focused receptacle may improve throughput for delivery companies, reduce incidents of theft from a front porch/door, and encourage more people to feel safe ordering home deliveries of all sizes.

A box receptacle device may be constructed using materials including but not limited to rods, wires, hooks, or hoops which may be made using materials including but not limited to steel, plastic, aluminum, or similar parts in a security grade form. A box receptacle may further be custom shaped and custom reinforced for a specific receptacle's folding mechanism and rugged use. A folding mechanism may also have additional foldable features added including but not limited to a folding mechanism resulting in a table, a folding mechanism operable using solely a foot, a mechanism to give feedback of locking success, a mechanism where a box receptacle folded up may serve as a chair for a porch. A thickness of a mesh material may be custom adjusted to meet structural and security needs of any size receptacle. Building materials laid out in a mesh style may make this receptacle lighter and thus relatively easy to fold.

Additional features may be easily integrated with a box receptacle. Since in an exemplary embodiment it may use no electricity, it may be relatively easy to add no-power or very low power sensors or controllers. Or alternatively it may be relatively easy to add electricity since it may be mounted onto a home wall. Since a box receptacle may be mounted on a wall there may also be Wi-Fi located on an opposite side of a wall in a home. This may allow a user's mobile device to interface with a box receptacle.

A storage box device may improve a standard delivery drop off box by having an initial wide-open/unlocked state when expecting a package and a self-locking mechanism triggered after a receptacle's lid may be closed shut by a delivery driver. A self-locking mechanism may be a one-time use mechanism, which may further speed up a delivery driver drop-off. There may additionally be mechanical feedback given to a delivery driver to confirm locked status, or a resistance spring added to a delivery driver has to push down additionally so accidental closings may be avoided. The storage box device may be mounted on a wall with screws through a plurality of back support metal strips with screw holes. Once a delivery person drops off a package inside the device and closes the lid, the lock activates and secures the door. Once the lock is activated, it can only be opened with a key. This ensures the package is safe from predators.

An exemplary box receptacle device may have three states including but not limited to a folded up flat state while not in use, an open state while expecting a box, and a closed/locked state after a drop off. A folding/collapsing and unfolding/expanding mechanism for a box receptacle may include folding a folding back panel. All panels may fold flat and end up stacked over a back panel mounted on a wall. A folding mechanism may use a special hinge setup to make it easier to operate. A special hinge may use a loop tip to connect panels, which may allow a panel to more smoothly swing up to 180 degrees.

FIG. 1 illustrates an exemplary box receptacle device in a closed/locked state, in accordance with an embodiment of the invention. A box receptacle in a closed/locked state occurs when a delivery driver may have just dropped off a box and close the top panel, which may trigger a self-locking mechanism. A box receptacle device may use a top locking mechanism 105 and a bottom locking mechanism 110, both utilizing a male-female locking mechanism. A locking mechanism may further be self-locking to ease operation for a delivery driver. There may be a plurality of alternatives to this type of locking means used. Furthermore, [[a]] bottom locking mechanism 110 may be optional, which may be leveraged to further improve ease of folding mechanism and/or security. This may also allow a bottom locking mechanism 110 to be replaced with a remove-ably rigid lower frame. A box receptacle device may be relatively less complicated to install than previous box receptacles/lockers due to the back support panel having a plurality of metal or plastic strips/bars 115 with holes for security screws which may be attached to any wall. A receptacle may be made from a mesh see-through material or it may be made from plastic, wood, or other common types of materials used in making secure lockers. Box panels may be customized for a particular type of prevalent weather in a location. A box receptacle device may further have a back-plane piece for holding special hinge-based mechanisms 120.

Figure 2:
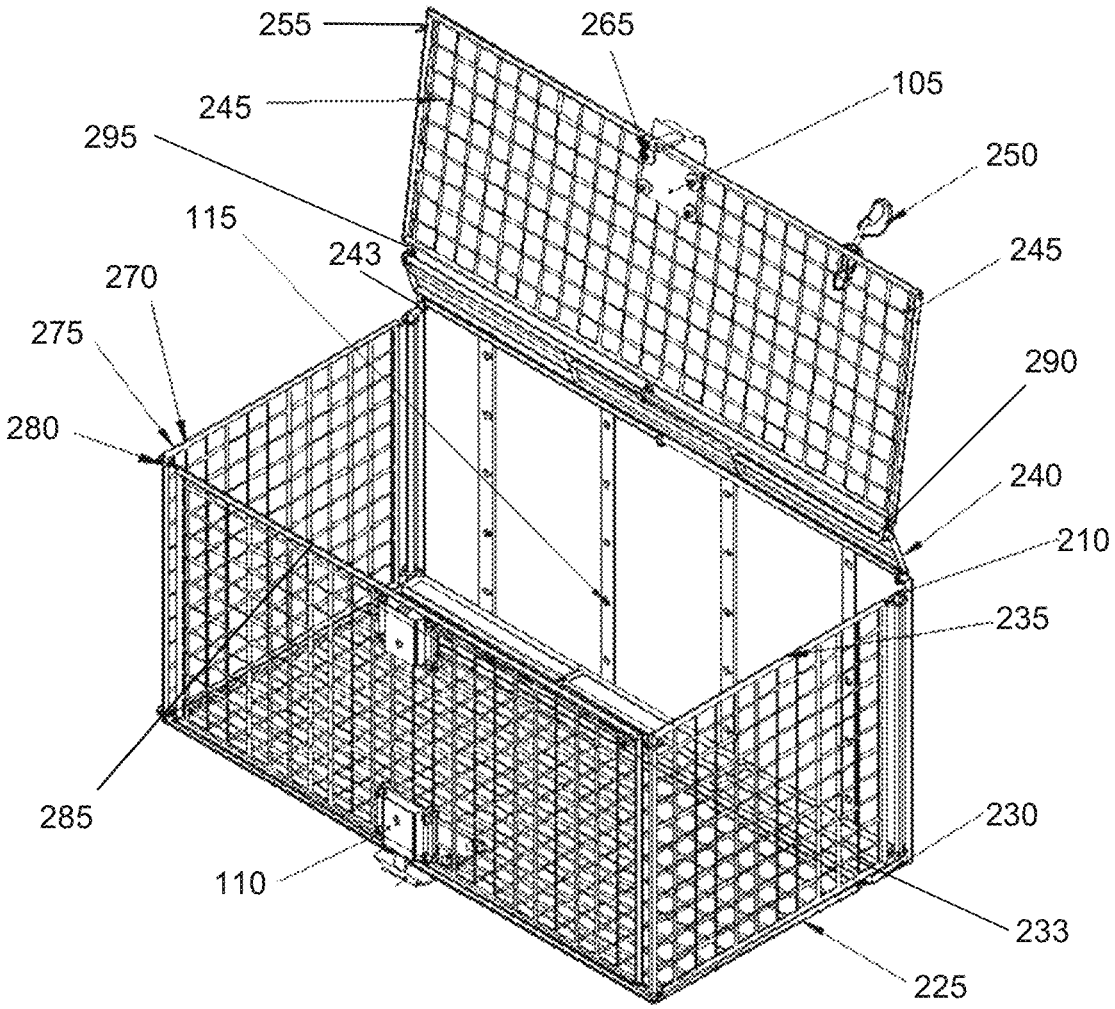
FIG. 2 illustrates an exemplary box receptacle in an open/unlocked state, in accordance with an embodiment of the invention.

FIG. 2 illustrates an exemplary box receptacle device in an open/unlocked state, in accordance with an embodiment of the invention. A box may be in an open/unlocked state before a delivery driver drops off a box. A box receptacle device may be mounted onto a wall using a plurality of strips/bars 115, as shown by way of example in FIG. 1, having security screw holes 205 on a back support panel of a box receptacle. The plurality of strips 115 may include but not limited to metal, plastic, or wood strips/bars. The strips 115 for security screws may be attached to a surrounding bar or rod of the back support panel. Special hinge-based mechanism 120 may comprise special hinge-based parts 210, 280 connecting the front panel 285 to side panels 235, 270 which may make folding easier. The hinge-based parts 210, 280 may include a hinge loop configured to engage a hinge bar 295 which may allow the connecting parts to swing at least 180 degrees from side to side. A receptacle may then have a bottom locking mechanism 110 and a top locking mechanism 105 to use in a self-locking manner, these locking mechanisms 110 and 105 may be male-female type of locks. The locking mechanisms 110 and 105 may come pre-installed with security screws 265. A bottom panel 225 may only swing up to 90 degrees, which may help unfolding easily into place and supporting a weight of a box better. Alternatively, an adjustment may have a bottom panel with a pole unfolding out for support. A bottom panel 225 may connect to a special hinge-based folding back panel at a bottom back panel connection point 230. Connection point 230 may connect a bottom panel 225 with a side panel 235 or 270. A side panel 235 or 270 may connect with a top sub-panel 240 at point 243. A top panel/lid 245 may be a preferred panel for inserting boxes, a delivery driver may just need to drop it off as if there was no box receptacle then a box receptacle may self-lock, and a delivery completes quickly. A box receptacle top panel/lid 245 may further have a snapping hook 250. The snapping hook 250 may be snapped to the wall, which typically inhibits the top panel/lid 245 from closing when the box is in an open position. A top sub-panel 240 may connect the top panel with the back support panel. The top sub-panel 240 may include a hinge loop portion 290 configured to engage the surrounding support bar of the back support panel. The bottom sub-panel 230 may hingedly connect the bottom panel with the back support panel similar to the top sub-panel 240. The bottom sub-panel 233 may include a hinge loop portion configured to engage the surrounding support bar of the back support panel. The top and bottom sub-panels 240 and 233 may provide a clearance when the device is folded during non-use.

Figure 3:
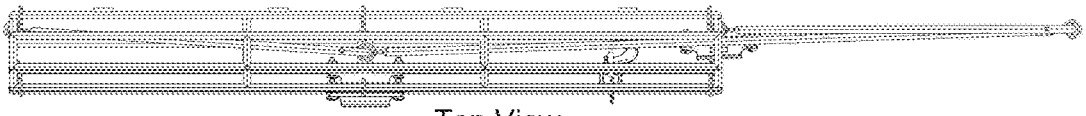
FIG. 3 illustrates an exemplary box receptacle in folded/collapsed state, in accordance with an embodiment of the invention.
Figure 3:
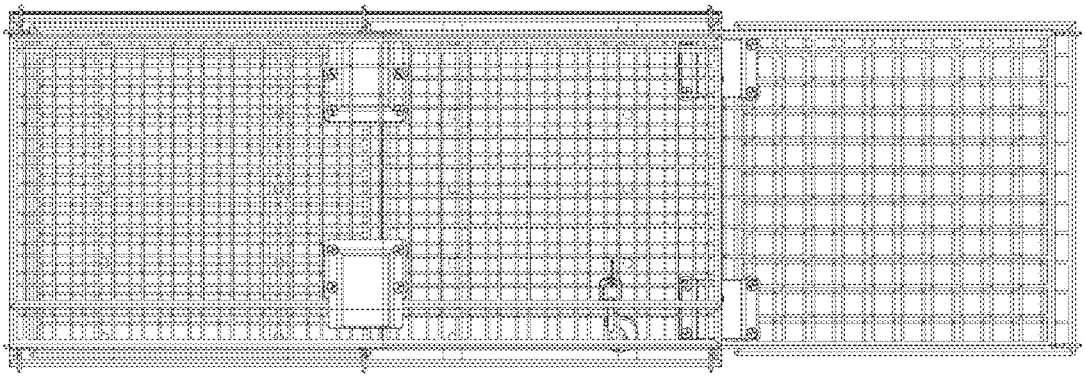
Figure 3:
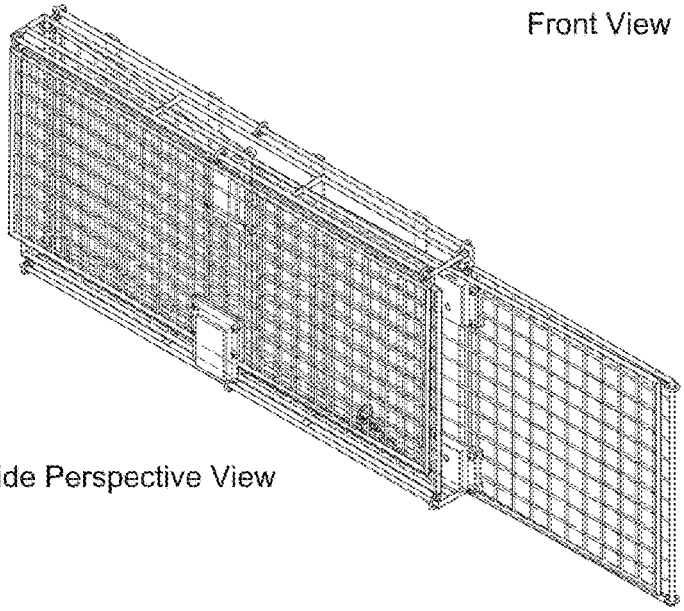
Figure 3:
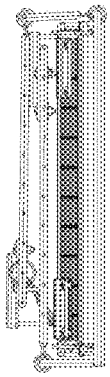
Figure 3:
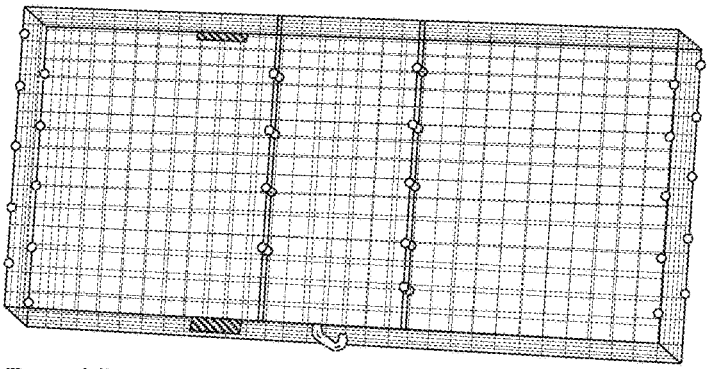

FIG. 3 illustrates an exemplary box receptacle device in folded/collapsed state, in accordance with an embodiment of the invention. The device includes several sub panels which may help in collapsing the device by using minimum amount of space and giving an aesthetic appearance. The special hinges may allow the side and front panels to move horizontally, either towards the right or the left all the way toward the wall, making it flush before unfolding the floor panel and top panels. A box in a folded/collapsed state may be at a point of long term non-use. The material used may include but not limited to steel mesh and coated with all-weather resistant paint, which may keep the box free from defect when exposed to prolonged period in outdoor environment. A box receptacle may fold up over a back panel, which may only need to take up as much space as a thick back panel. This may save space and allow even small apartments or small homes with limited space to have their own mounted high security locker. The device may be collapsed while mounted, all the way flush to the wall, utilizing minimum space and avoid safety hazard. The locking mechanism on the floor panel ensures the box is secured at the bottom portion of the device. Optionally this may end up shaped differently than flat against a wall when it may be unfolded/collapsed. This may fold into a chair/table or other useful piece of furniture to have on your porch. To unfold the device, one may perform the previous task in reverse and leave the upper panel open and the lower panel closed and locked.

Figure 4:
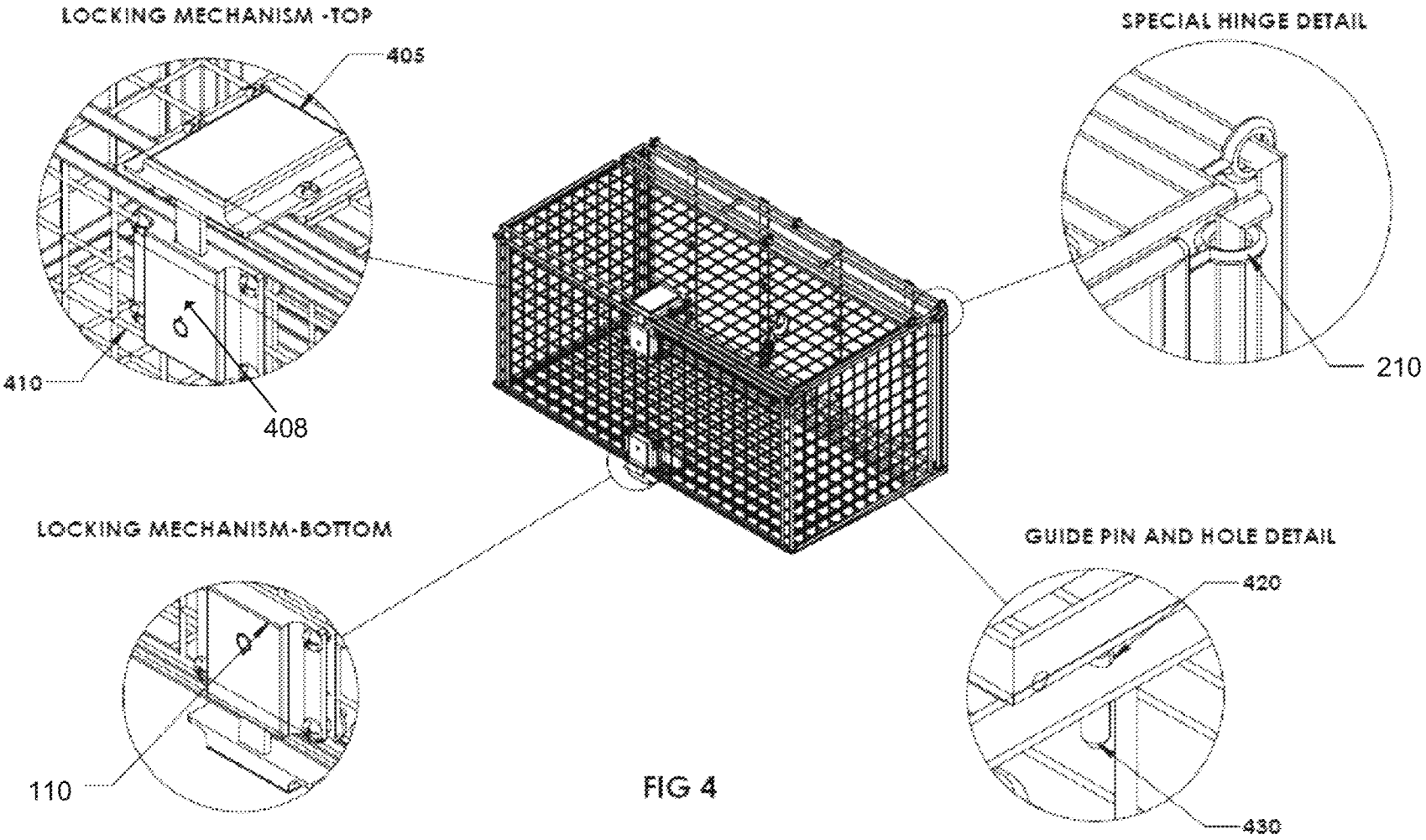
FIG. 4 illustrates an exemplary box receptacle in a closed/locked state, in accordance with an embodiment of the invention.

FIG. 4 illustrates an exemplary box receptacle device in a closed/locked state, in accordance with an embodiment of the invention. An exemplary structure may have a male-female locking mechanism comprising an upper lock portion 405 in a top panel 245 and a lower lock portion 408 in a front panel 410 of a box receptacle. A second, bottom lock 110 may be added, using similar mechanisms as[[t]] a top lock. A box receptacle may use a guide pin 430 implement and a hole portion 420 to guide an unfolding receptacle into place. Further, a guide pin 430 on the top panel may align with a hole portion 420 in the side panel, which helps position the box before the lock is engaged. A special custom hinge piece, hinge loop 210, may be used to improve its folding. A special hinge using a loop tip engaged with a bar or rod on the back support panel may allow a receptacle's pieces to relatively easily swing up to 180 degrees along a wall. Therefore, a special hinge may significantly simplify folding a box receptacle for both a delivery recipient and delivery driver. The device will be made as a single and multiple compartments, each compartment will have its own locking mechanism.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant (s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing delivery receptacles according to the present invention will be apparent to those skilled in the art. Various aspects of the invention have been described above by way of illustration, and the specific embodiments disclosed are not intended to limit the invention to the particular forms disclosed. The particular implementation of the delivery receptacles may vary depending upon the particular context or application. By way of example, and not limitation, the delivery receptacles described in the foregoing were principally directed to self-locking and collapsible box delivery receptacles implementations; however, similar techniques may instead be applied to animal crates, lockers at schools, lockers in airports or train stations, mail receptacles for office buildings, walls set apart solely for a large number of box receptacles (which may make delivery much easier and help pick-up if this wall may be located on a busy convenient location like a highway exit), which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a front panel component, in which said front panel component comprises at least one front panel mesh and a surrounding bar portion, wherein said surrounding bar portion is configured to support said front panel mesh;

a top panel component, in which said top panel component comprises at least one top panel mesh and a surrounding bar portion, wherein said surrounding bar portion is configured to support said top panel mesh;

a first locking mechanism, in which said first locking mechanism comprises at least a first female locking mechanism disposed on an upper portion of said front panel component, and a first male locking mechanism disposed on a front portion of said top panel component;

a bottom panel component, in which said bottom panel component comprises at least one bottom panel mesh and a surrounding bar portion, wherein said surrounding bar portion is configured to support said bottom panel mesh;

a second locking mechanism, in which said second locking mechanism comprises at least a second female locking mechanism disposed on a lower portion of said front panel component, and a second male locking mechanism disposed on a front portion of said bottom panel component;

a back support panel component, wherein said back support panel component is configured to be operable for mounting onto a wall; and a hinge mechanism, wherein said hinge mechanism is configured to be operable for allowing the device to be folded or collapsed when not in use.

2. The device of claim 1, in which said back support panel component comprises at least two or more strip constituents, each strip constituent having a plurality of screw holes operable for mounting said back support panel component onto the wall with screws.

3. The device of claim 2, in which said back support panel component further comprises a surrounding bar or rod that is configured to support said at least two or more strip constituents.

4. The device of claim 3, in which said back support panel component further comprises a left side hinge bar or rod element and a right side hinge bar or rod element, each of which is configured to engage a hinge loop, wherein said left side hinge bar or rod element, said right side hinge bar or rod element and hinge loop are components of said hinge mechanism configured to be operable for allowing the device to be folded or collapsed.

5. The device of claim 4, further comprising a left side panel component, in which said left side panel component comprises at least one left side panel mesh and a surrounding bar portion, wherein said surrounding bar portion is configured to support said left side panel mesh, wherein said left side panel component is operable for swinging left or right.

6. The device of claim 5, in which said left side panel component comprises a left side panel hinge loop portion that is configured to engage said back support panel left side hinge bar, wherein said left side panel hinge loop portion is a component of said hinge mechanism configured to be operable for allowing the device to be folded or collapsed.

7. The device of claim 6, further comprising a right side panel component, in which said front panel component comprises at least one right side panel mesh and a surrounding bar portion, wherein said surrounding bar portion is configured to support said right side panel mesh, wherein said right side panel component is operable for swinging left or right.

8. The device of claim 7, in which said right side panel component comprises a right side panel hinge loop portion that is configured to engage said back support panel right side hinge bar, wherein said right side panel hinge loop portion is a component of said hinge mechanism configured to be operable for allowing the device to be folded or collapsed.

9. The device of claim 8, further comprising a top sub-panel that is configured to engage said top panel component with said back support panel component.

10. The device of claim 9, in which said top sub-panel comprises at least one or more top sub-panel hinge loop that is configured to engage said surrounding bar portion of said back support panel component and top panel component, wherein said one or more top sub-panel hinge loop is a component of said hinge mechanism configured to be operable for allowing the device to be folded or collapsed.

11. The device of claim 10, further comprising a guide pin implement, wherein said guide pin implement is configured to help position said top panel component before said first locking mechanism is activated.

12. The device of claim 11, further comprising a guide hole portion, wherein said guide hole portion is configured to align with said guide pin implement.

13. The device of claim 12, further comprising a bottom sub-panel that is configured to engage said bottom panel component with said back support panel component.

14. The device of claim 13, in which said bottom sub-panel comprises at least one or more bottom sub-panel hinge loop that is configured to engage said surrounding bar of said back support panel component and said bottom panel component, wherein said one or more bottom sub-panel hinge loop portion is a component of said hinge mechanism configured to be operable for allowing the device to be folded or collapsed.

15. The device of claim 14, further comprising a pole mechanism, wherein said pole mechanism is configured to be operable for unfolding out to support said bottom panel component.

16. A device comprising:

a receptacle implement, wherein said receptacle implement is configured to be operable for receiving and storing a package;

a mesh component disposed on a proximate front panel of said receptacle implement, in which said front panel further comprises at least a surrounding bar portion, wherein said surrounding bar portion is configured to support said front panel mesh component;

a top panel component disposed as a lid component of said receptacle implement, in which said top panel component comprises at least one of top panel mesh and a surrounding bar portion, wherein said surrounding bar portion is configured to support said top panel mesh;

a first locking mechanism, said first locking mechanism comprises at least a first female locking mechanism disposed on an upper portion of said front panel, in which said first locking mechanism further comprises a first male locking mechanism disposed on a front portion of said top panel component;

a bottom panel component disposed on a bottom portion of said receptacle implement, in which said bottom panel component comprises at least one bottom panel mesh and a surrounding bar portion, wherein said surrounding bar portion is configured to support said bottom panel mesh;

a second locking mechanism, in which said second locking mechanism comprises at least a second female locking mechanism disposed on a lower portion of said front panel mesh component and a second male locking mechanism disposed on a front portion of said bottom panel component;

a back support panel component, wherein said back support panel component is configured to be operable for mounting onto a surface of a wall; and a hinge mechanism, wherein said hinge mechanism is configured to allow the receptacle implement to be folded or collapsed when not in use.

17. The device of claim 16, in which said back support panel component comprises:

at least two or more strip constituents, each strip constituent having a plurality of screw holes operable for mounting said back support panel component onto the wall with screws;

a surrounding bar or rod that is configured to support said at least two or more strip constituents; and a left and right side hinge bar or rod element that is configured to engage a hinge loop, wherein said left and right side hinge bar or rod elements and said hinge loop are components of said hinge mechanism configured to allow the receptacle implement to be folded or collapsed.

18. The device of claim 17, further comprising:

a left side panel component, in which said left side panel component comprises at least one left side panel mesh and a surrounding bar portion, wherein said surrounding bar portion is configured to support said left side panel mesh, wherein said left side panel component is operable for swinging left or right, in which said left side panel component comprises a left side panel hinge loop portion that is configured to engage said back support panel left side hinge bar, wherein said left side panel hinge loop portion is a component of said hinge mechanism configured to allow the receptacle implement to be folded or collapsed; and a right side panel component, in which said right side panel component comprises at least one right side panel mesh and a surrounding bar portion, wherein said surrounding bar portion is configured to support said right side panel mesh, wherein said right side panel component is operable for swinging left or right, in which said right side panel component comprises a right side panel hinge loop portion that is configured to engage said back support panel right side hinge bar, wherein said right side panel hinge loop portion is a component of said hinge mechanism configured to allow the receptacle implement to be folded or collapsed.

19. The device of claim 18, further comprising:

a top sub-panel that is configured to engage said top panel component with said back support panel component, in which said top sub-panel comprises a top sub-panel hinge loop that is configured to engage said surrounding bar portion of said back support panel component, wherein said top sub-panel hinge loop is a component of said hinge mechanism configured to allow the receptacle implement to be folded or collapsed; and a bottom sub-panel that is configured to engage said bottom panel component with said back support panel component, in which said bottom sub-panel comprises a bottom sub-panel hinge loop that is configured to engage said surrounding bar of said back support panel component, wherein said bottom sub-panel hinge loop is a component of said hinge mechanism configured to allow the receptacle implement to be folded or collapsed;

a guide pin implement disposed on said top panel component, wherein said guide pin implement is configured to help position said top panel component before said first locking mechanism is activated; and a guide hole portion, wherein said guide hole portion is configured to align with said guide pin implement.

* * * * *